US008413593B2

(12) United States Patent
Korb

(10) Patent No.: US 8,413,593 B2
(45) Date of Patent: Apr. 9, 2013

(54) TABLE WITH PIVOTABLE TABLE TOP

(75) Inventor: Daniel Korb, Baden (CH)

(73) Assignee: DSA International, Inc., Zeeland, MI (US)

( * ) Notice: Subject to any disclaimer, the term of this patent is extended or adjusted under 35 U.S.C. 154(b) by 59 days.

(21) Appl. No.: 13/025,775

(22) Filed: Feb. 11, 2011

(65) Prior Publication Data

US 2011/0139042 A1 Jun. 16, 2011

Related U.S. Application Data

(63) Continuation of application No. PCT/EP2009/004891, filed on Jul. 7, 2009.

(30) Foreign Application Priority Data

Aug. 11, 2008 (DE) ..... 10 2008 037 285

(51) Int. Cl.
*A47F 5/12* (2006.01)

(52) U.S. Cl.
USPC ..... 108/6; 108/115

(58) Field of Classification Search ..... 108/6, 7, 108/9, 118, 123, 124, 128, 131, 132, 133, 108/115; 248/188.1, 188.6, 188.7, 434, 439, 248/166, 371
See application file for complete search history.

(56) References Cited

U.S. PATENT DOCUMENTS

| | | | | |
|---|---|---|---|---|
| 120,550 | A | 10/1871 | Thornton | 108/6 |
| 963,439 | A | 7/1910 | Hastings | 108/132 |
| 1,203,783 | A | 11/1916 | Reischmann | 108/132 |
| 1,752,304 | A | 4/1930 | Kovats | 108/126 |
| 2,121,398 | A | 6/1938 | Dukes | 108/79 |
| 2,823,087 | A | 2/1958 | Zimmer | 108/18 |
| 2,978,895 | A | 4/1961 | Heisler | 70/57 |
| 3,166,029 | A | 1/1965 | Acton | 108/124 |

(Continued)

FOREIGN PATENT DOCUMENTS

| | | |
|---|---|---|
| DE | 9011229 | 10/1990 |
| DE | 10038223 | 2/2002 |

(Continued)

OTHER PUBLICATIONS

International Search Report for PCT/EP2009/004891, Oct. 14, 2009.

*Primary Examiner* — Jose V Chen
*Assistant Examiner* — Matthew Ing
(74) *Attorney, Agent, or Firm* — Dowell IP, P.C.

(57) ABSTRACT

Presented is a table with a pivotable table top that is mounted rotatably and lockably about an axis of rotation extending in a longitudinal direction. The table has a pivoting mechanism on a table frame in the upper region of two lateral table legs. The table can be folded out or folded between a horizontal use position and a storage position. A pivoting movement of the table top is achieved, while combining secure operation and simple handling. The pivoting mechanism includes at least one pair of inter-engaging, mutually complementary tooth portions that are arranged concentrically about the axis of rotation. The tooth portions can be moved apart relative to one another by at least the tooth depth in the direction of the axis of rotation in order to enable the pivoting movement. In each pair, one tooth portion is mounted fixedly in terms of rotation with respect to the table leg and the other tooth portion is mounted fixedly in terms of rotation with respect to the table top.

20 Claims, 11 Drawing Sheets

U.S. PATENT DOCUMENTS

| | | | | | |
|---|---|---|---|---|---|
| 3,199,825 | A | | 8/1965 | Bellows | 248/397 |
| 3,349,728 | A | | 10/1967 | Barecki | 108/131 |
| 3,547,486 | A | * | 12/1970 | Herzer et al. | 297/408 |
| 3,554,141 | A | | 1/1971 | Burr | 108/132 |
| 3,641,946 | A | | 2/1972 | Channay | 108/6 |
| 3,796,169 | A | | 3/1974 | Bales | 108/116 |
| 3,874,696 | A | * | 4/1975 | Gardner et al. | 254/419 |
| 3,891,329 | A | | 6/1975 | Kato | 401/65 |
| 3,993,004 | A | | 11/1976 | Alme | 108/124 |
| 4,064,815 | A | * | 12/1977 | Baum | 108/129 |
| 4,643,105 | A | | 2/1987 | Baum | 108/150 |
| 4,773,337 | A | | 9/1988 | Ball | 108/124 |
| 4,838,181 | A | | 6/1989 | Luyk | 108/156 |
| 4,986,195 | A | | 1/1991 | Diffrient | 108/150 |
| 5,121,697 | A | | 6/1992 | Baum | 108/124 |
| 5,174,225 | A | | 12/1992 | Reise | 108/150 |
| 5,205,223 | A | | 4/1993 | Ball | 108/124 |
| 5,323,713 | A | | 6/1994 | Luyk | 108/131 |
| 5,354,027 | A | | 10/1994 | Cox | 248/292.14 |
| 5,673,633 | A | | 10/1997 | Pfister | 108/132 |
| 5,816,545 | A | * | 10/1998 | Malizia | 248/164 |
| 5,845,589 | A | | 12/1998 | Pfister | 108/132 |
| 6,006,880 | A | | 12/1999 | Daniel | 192/3.57 |
| 6,336,414 | B1 | | 1/2002 | Stewart | 108/50.02 |
| 6,386,119 | B1 | | 5/2002 | Lin | 108/133 |
| 6,394,005 | B1 | | 5/2002 | Isensee | 108/132 |
| 6,598,544 | B2 | | 7/2003 | Laws | 108/131 |
| 6,637,352 | B1 | | 10/2003 | Thode | 108/132 |
| 6,694,891 | B1 | * | 2/2004 | Lai | 108/6 |
| 6,845,723 | B2 | | 1/2005 | Kottman | 108/132 |
| 7,007,587 | B2 | | 3/2006 | Zanden | 91/437 |
| 7,107,915 | B2 | * | 9/2006 | Laws et al. | 108/131 |
| 7,350,469 | B2 | | 4/2008 | Koning | 108/132 |
| 7,703,400 | B2 | * | 4/2010 | Mockel | 108/115 |
| 7,878,128 | B2 | * | 2/2011 | Watson et al. | 108/132 |
| 8,069,795 | B1 | * | 12/2011 | Williams et al. | 108/115 |
| 8,104,987 | B2 | * | 1/2012 | Johnson | 403/104 |
| 2007/0261609 | A1 | * | 11/2007 | Kumazawa | 108/6 |

FOREIGN PATENT DOCUMENTS

| | | |
|---|---|---|
| DE | 10260503 | 7/2004 |
| EP | 1159887 | 12/2001 |
| EP | 1308109 | 5/2003 |
| EP | 1836926 | 9/2007 |
| GB | 2430874 | 4/2007 |
| JP | 10211023 | 8/1998 |
| WO | WO0113762 | 3/2001 |
| WO | WO0154538 | 8/2001 |

* cited by examiner

TABLE WITH PIVOTABLE TABLE TOP

CROSS REFERENCE TO COPENDING APPLICATIONS

This application is a continuation of PCT application No. PCT/EP/2009/004891 filed on Jul. 7, 2009 that designates the United States and claims priority to German Patent application DE 10 2008 037 285.4 filed Aug. 11, 2008 by Daniel Korb, the contents of which are all herein incorporated by reference.

FIELD OF THE INVENTION

The invention relates to a table with a hinged table top having a pivoting mechanism in the table frame. The table top rotates about a horizontal axis and is lockable in both a vertical storage position and a horizontal use position.

BACKGROUND OF THE INVENTION

A folding table is described in European Patent EP 1 308 109 B1 with a table top rotatable about a horizontal axis. The table top is mounted on a table frame so that it can be turned and folded between a horizontal use position and a substantially vertical storage position. The swivel mechanism is designed to simultaneously pivot the table top relative to two side legs. For enabling the pivotal movement on both sides of the table top, cross members are included. The combined pivotal movement of the table top and rotational movement of the legs with the swivel mechanism in EP 1 308 109 B1 is relatively complicated with a correspondingly large number of individual components.

Other tables with swivel table tops are described in JP 10211023, U.S. Pat. No. 6,845,723, WO 01/54538, WO 01/13762, DE 90 11 229, EP 1 159 887, DE 102 60 503 and DE 100 38 223.

SUMMARY OF THE INVENTION

Disclosed is a table having a simple construction with a secure, easy-to-use, multifunction folding and unfolding table top.

The pivot mechanism of the table includes a pair of interlocking, mutually complementary, concentrically arranged tooth sections that are laterally movable relative to each other by at least the depth of the teeth. The tooth sections move in the direction of the axis of rotation and allow the table top to pivot when not engaged. In each pair of tooth sections, one tooth section is rotationally stationary (secured or fixed) relative to the table leg while the other tooth section is rotationally stationary relative to the table top. The interlocking teeth sections produce a stable, free of play, table that may be pivoted into multiple positions relative to the legs by simply engaging and disengaging the tooth sections.

Apart from the folded and unfolded pivotal positions, the table may also be locked into intermediate positions.

The tooth sections are formed in rings that are capable of interlocking with each other at a plurality of angular rotations.

The swivel mechanism may include a defined pivot angle and swivel range that limit the pivot of the table top to between the horizontal use and vertical storage configurations. In an exemplary example, the pivot range is defined by a cylindrical path that extends a defined distance, such as 90 or 180 degrees around a circular member. A limiting mechanism travels within the cylindrical path and prevents further rotation of the table when the end of the path is reached. Well within the cylindrical path may be added a well to lock the limiting element at set locations and define the angles at which the table top may be locked, such as horizontal, vertical, and 45 degrees.

The table includes a longitudinal beam extending below the table top along the rotational axis. Extending from the beam are cross members which extend perpendicularly to the beam and are secured to the table top.

The low cost swivel mechanism is provided with a cylindrical section that is rotated when pivoting the table about the rotation axis, and a cylindrical spigot that is configured to be inserted into the cylinder section. The cylinder section slidably and rotatablely connects to the spigot. In one embodiment, the cylinder section is integrally formed as part of the longitudinal beam. The simple, sturdy construction is enhanced by a limiting element mounted on the cylinder section that extends parallel to the axis of rotation. The limiting element travels in a cylindric track or recess (that is curved about the axis of rotation) than includes wells at various locations that correspond to the table top being at predefined angles such as horizontal or vertical. The limiting element fits into the well to prevent the table from rotating when engaged within the well.

When the limiting element is within the cylindrical track, the teeth are disengaged from each other so that the table top may freely pivot, however when the limiting element is within a well, the teeth are engaged so that the table top is prevented from rotating. By adding additional wells in the cylindrical track, intermediate positions are possible for the pivoting table top. By increasing the depth of the recess so that the teeth may be engaged when the limiting element is within the recess, numerous rotational settings can be selected for the table top. For example, slightly oblique inclinations of the table top relative to the horizontal setting may be selected by a user.

The table may be constructed such that a spring acts to engage or disengage the teeth sections from each other. The spring may be arranged within a bearing piece and connected to a supporting member such as a cap or flange. For easy handling and safe operation of the swivel mechanism, the table include an actuating linkage that act to engage and disengage the locking teeth. In one embodiment, the linkage extends within the longitudinal beam of the table frame.

The table may be stacked with several other tables in their folded positions. The offset arrangement of the legs in the lateral direction allows the tables to be stacked in a tighter configuration than would otherwise be possible. The table legs may be formed with or without wheels for rolling the tables.

BRIEF DESCRIPTION OF THE DRAWINGS

In FIGS. 1A and 1B, the longitudinal beam of the table is located under the middle of the table top while in FIGS. 1C and 1D the longitudinal beam is under the posterior region of the table top.

DETAILED DESCRIPTION

Figure 1A:
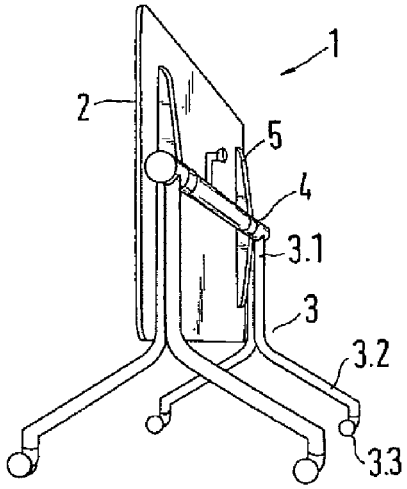
FIGS. 1A through 1D show perspective side views of two tables with tilting table tops (folding table) in the retracted or extended position of the table.
Figure 1B:
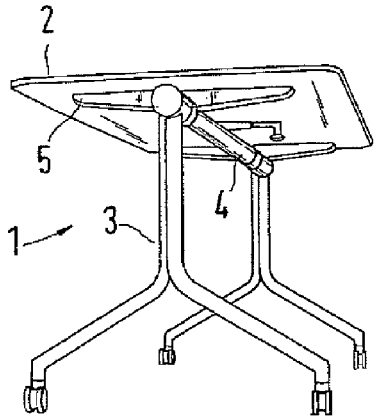
Figure 1C:
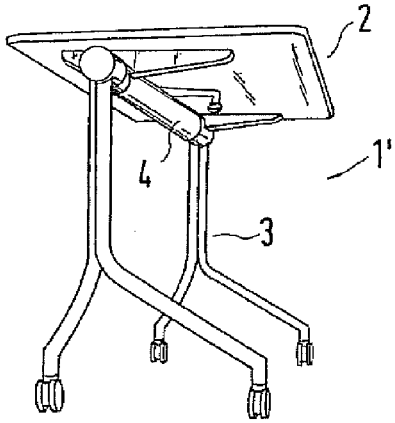
Figure 1D:
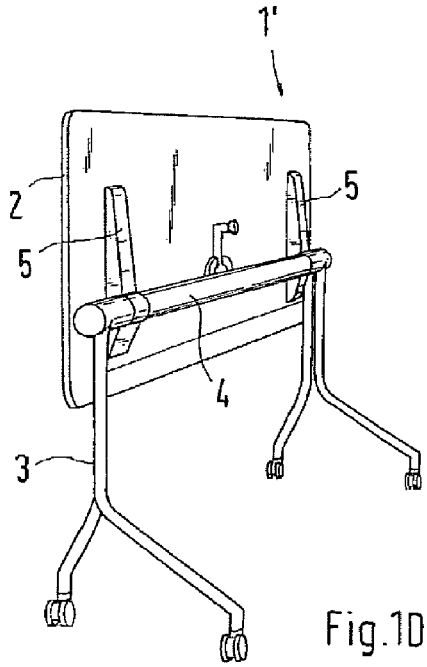
Figure 2A:
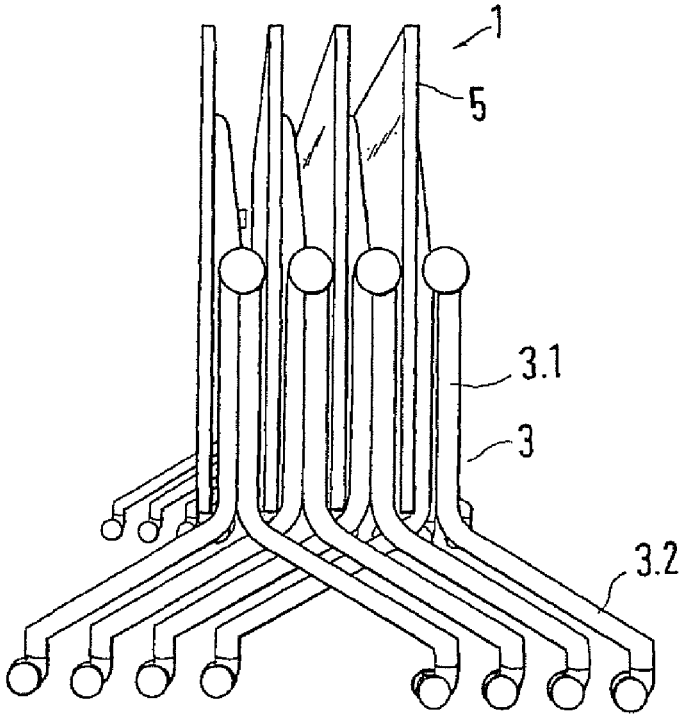
FIGS. 2A and 2B show several nested tables with the pivoted table tops in a perspective side view.
Figure 2B:
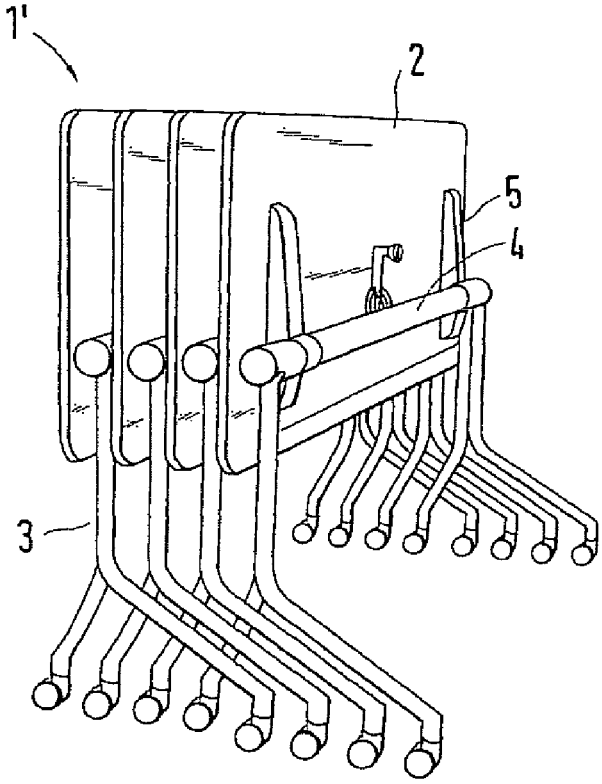
Figure 3:
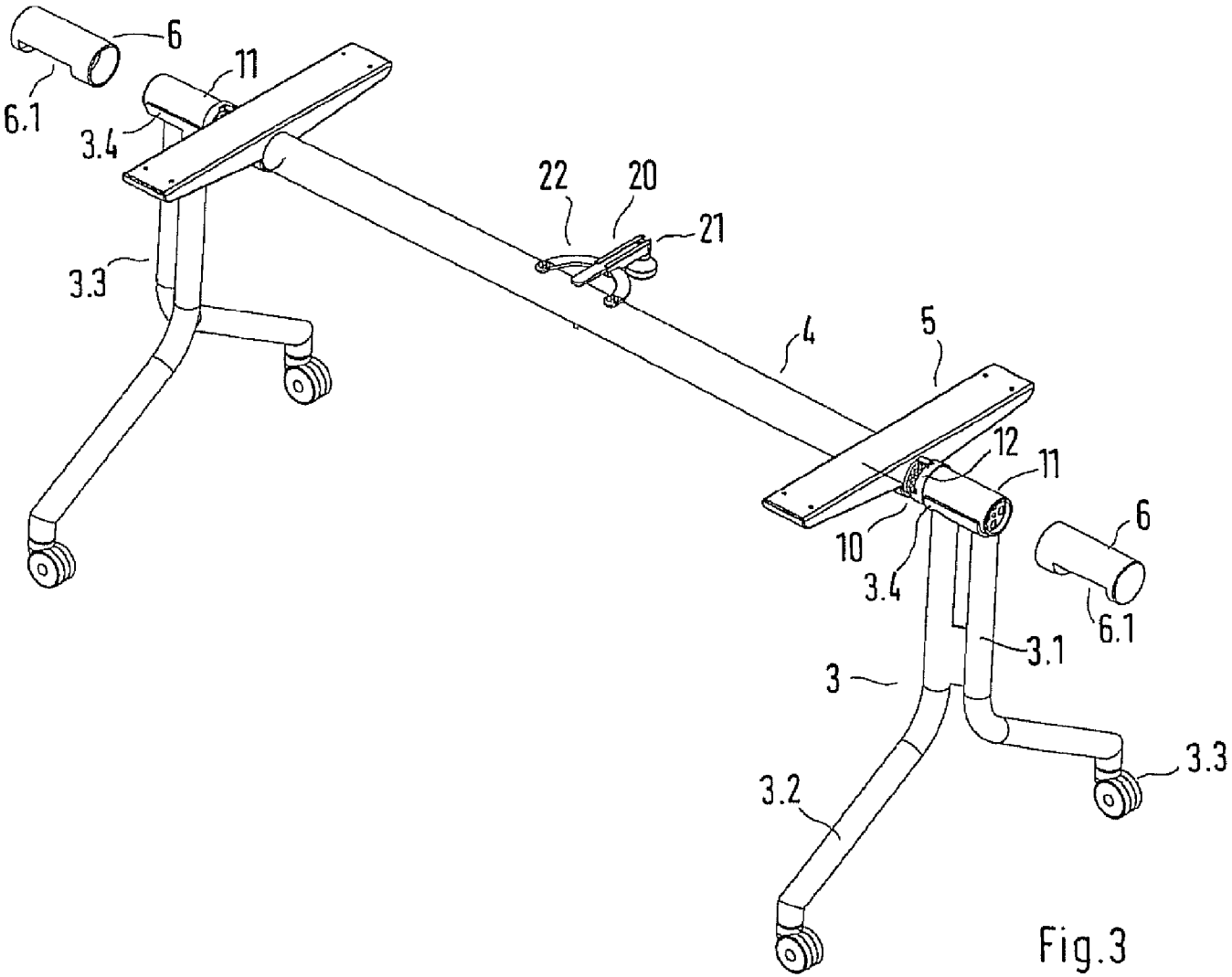
FIG. 3 shows a perspective view of a table frame with a longitudinal beam, two cross members, two side legs and end caps.

FIGS. 1A and 1B show a folding table 1 with a centrally disposed longitudinal beam 4 and a swivel table top 2. In FIG. 1A the table is in a pivoted, substantially vertical pivot position (storage position) while in FIG. 1B the table is shown in the horizontal pivot position (use position). In FIGS. 1C and 1D a second variation of the table is shown where the longitudinal beam 4 is located in the rear of the table. The illustrated table top 2 is rectangular; however the table top may have a different geometry such as square, oval or round. The table top 2 is connected near its two shorter side edges at its base to cross-beams 5. The cross-beams 5 are attached on one side to the table legs 3 through the longitudinal beam 4. The longitudinal beam 4 may extend under the center of the table top, as shown in FIGS. 1A and 1B, or maybe off-center near the rear of the table top as shown in FIGS. 1C and 1D. The supporting point of the legs is laterally outside of the cross members 5, but may still be below the table top 2. The table legs 3 have a top section 3.1 that is at least as long as the pivoted state downward portion of the table top 2. The table legs 3 can be equipped with T-leg or C-foot lower portions connected to rollers 3.3 that support leg portions having a variety of angles. The two part legs have upper vertical sections, which together form the top section 3.1 and short-transverse joints connected the vertical sections together. The top sections are perpendicular to the longitudinal beam 4 and in the depth direction of the cross member 5. As shown in FIG. 3, the top sections may be at an offset angle to one another. As shown in the representation of the table 1 in 2A and 2B, the longitudinal displacement of the legs can provide advantages for stacking the tables as compared to tables with linearly aligned legs. In the illustrated example, the longitudinal displacement of the leg sections is preferably at least the width of a leg in order to facilitate stacking of the tables. As shown in FIG. 3, the table legs 3 are connected through shells 3.4 to the longitudinal beam 4. The shells 3.4 are coupled to extension units that support them from the longitudinal beam 4. The extension unit has a bearing piece 11 in the form of a circular cylindrical hollow profile section as shown in the exploded views of FIGS. 5A and 5B.

The longitudinal beam 4 includes a circular cylindrical spigot 4.1 extending away from, but near to, the cross member 5. The spigot 4.1 may be an integrally formed part of the longitudinal beam or it may be a separately formed unit that is inserted into the longitudinal beam 4.

The outer diameter of the spigot 4.1 is adapted to the inner diameter of the hollow profile of the longitudinal beam 4 so that a stable fit results when the spigot 4.1 is within the hollow profile of the longitudinal beam 4. The inner diameter of the bearing piece 11 is set to be comparable to the external diameter of the spigot 4.1 so that the bearing section 11 is on the spigot 4.1 slidably and concentrically mounted to rotate about the axis of rotation. In order for the table top 2 to be supported along with the cross members 5 and the longitudinal beam 4 relative to the bearing piece 11 about the axis of rotation, the outer diameter of the bearing piece 11 preferably corresponds approximately to the outside diameter of the longitudinal beam 4 and may have the same hollow profile.

As shown in FIGS. 3, 4A through 4F and 5A through 5C the pivot mechanism 10 has a first set of teeth 15 on the bearing piece and a second set of teeth 17 on the spigot 4.1. The two sets of teeth face each other and have interlocking tapered teeth, so that a stable table top is provided when they are engaged and moving apart the teeth is done without difficulty.

Figure 4A:
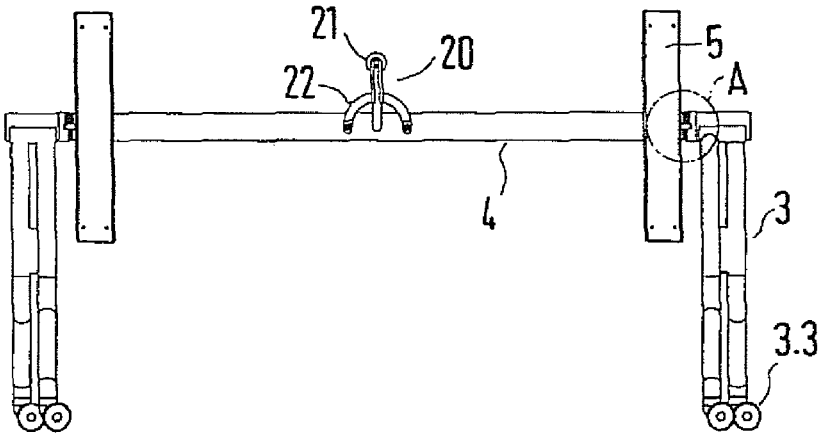
FIGS. 4A through 4F show back, plan view, perspective view and three detailed views of the table frame in FIG. 3.
Figure 4B:
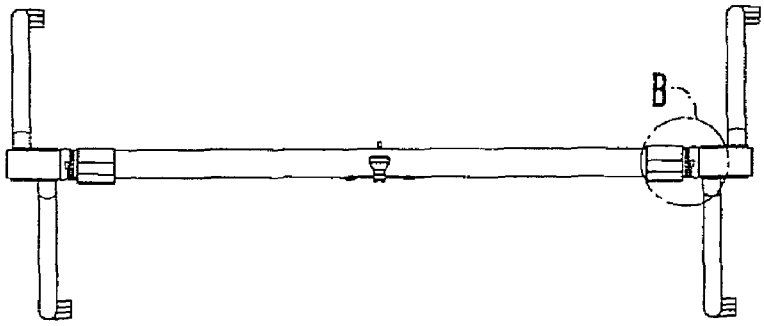
Figure 4C:
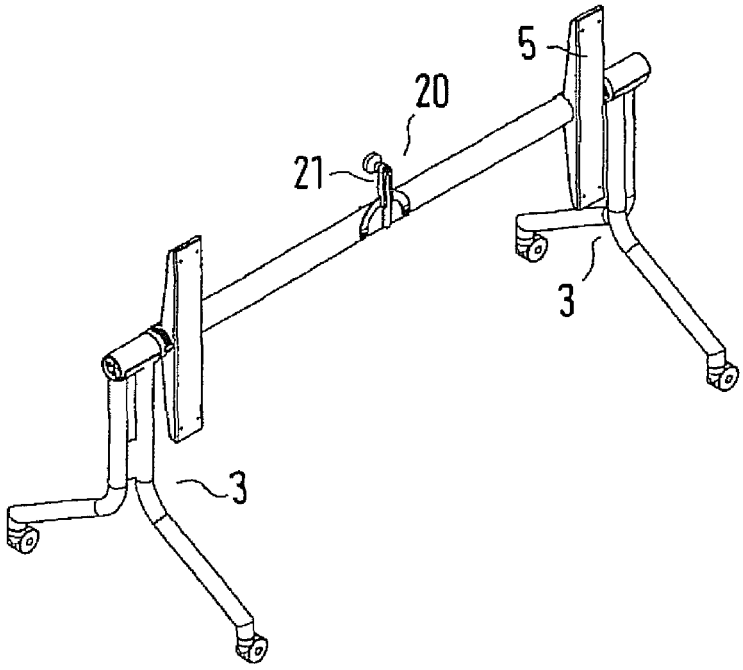
Figure 4D:
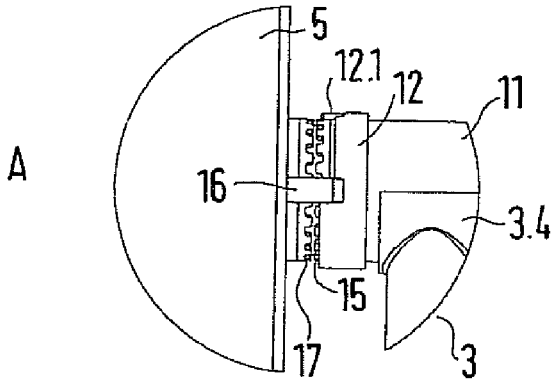
Figure 4E:
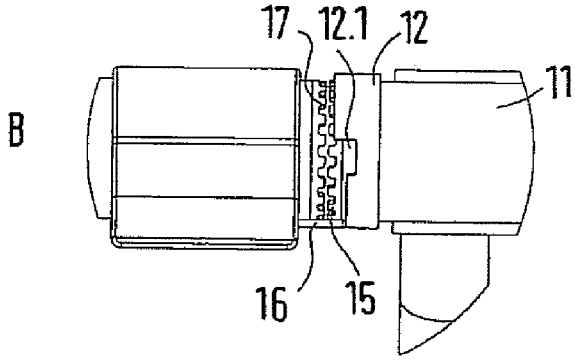
Figure 4F:
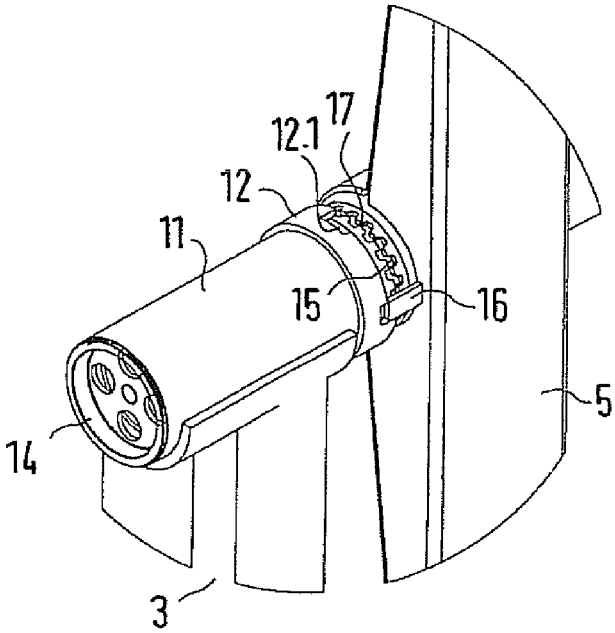

As shown in FIG. 4F, the outer diameter of the bearing piece 11 near the first set of teeth 15 includes a recess 12.1 that extends approximately a quarter of the circumference of the bearing piece. The spigot 4.1 near the second set of teeth 17 includes a limiting element 16 structured to slide within the recess 12.1 of the spigot. The recess acts to limit the rotation of the table top when the limiting element 16 strikes either end of the recessed path. In the mechanism shown in FIG. 4F, the recess extends a quarter of the way around the spigot so that the limiting element will strike the ends of the recess when the table top is roughly vertical and roughly horizontal.

Figure 5A:
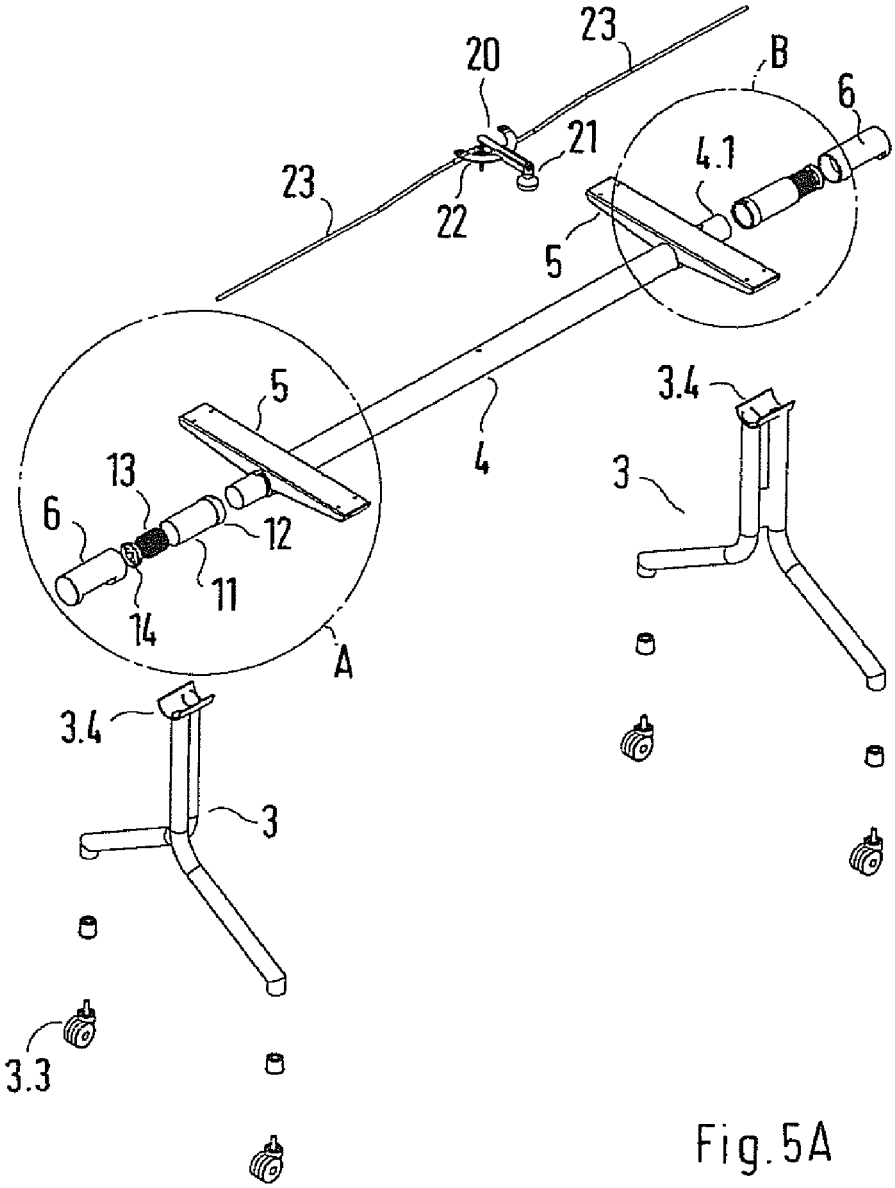
FIGS. 5A through 5C show the table frame of FIG. 3 in a disassembled view and two detail views of the swing mechanism.
Figure 5B:
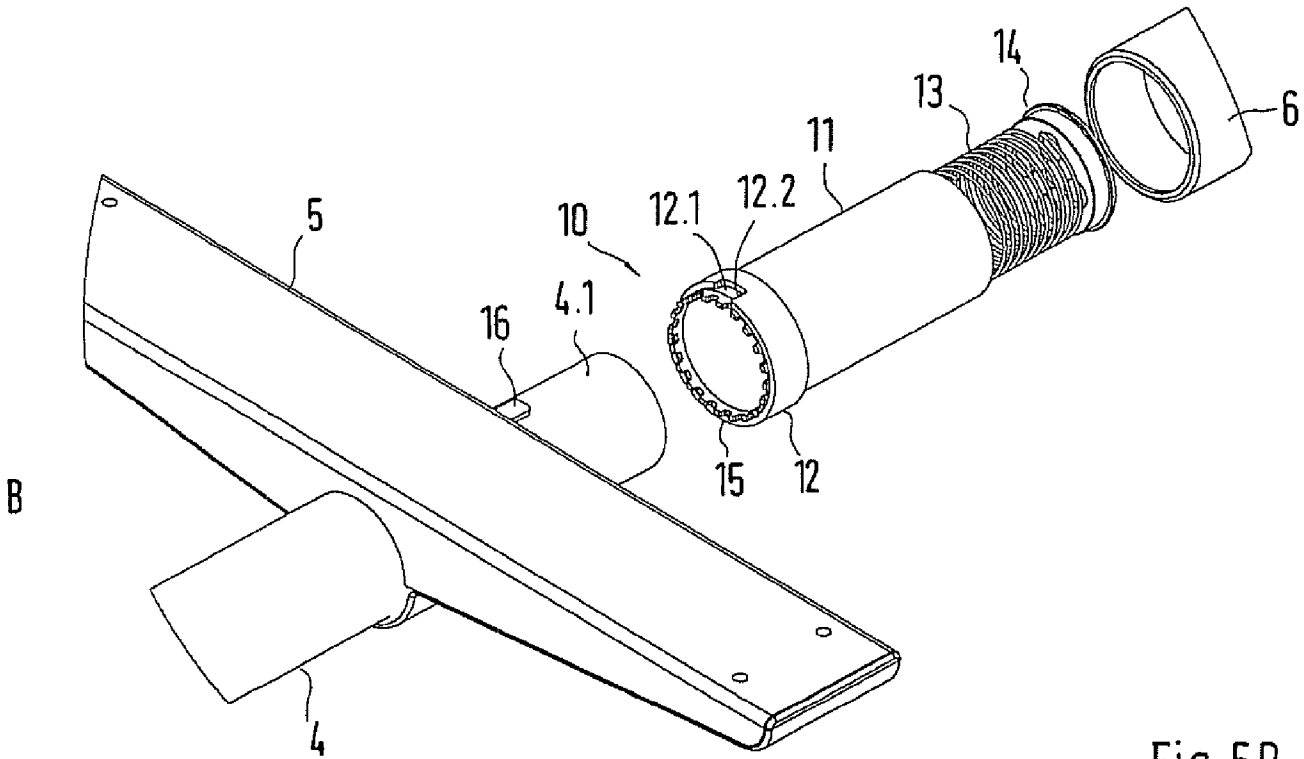

As shown in FIG. 5B, at two or more of the extreme positions of the table top (e.g., horizontal and vertical) the recess 12.1 includes wells 12.2 that engage with the limiting element 16 to further limit the rotation of the table top. The first set of teeth 15 circumscribe the bearing piece 11 (and the axis of rotation) and are concentric with the edge of the recess 12.1. The teeth of the first set of teeth extend out from the bearing piece parallel to the axis of rotation towards the second set of teeth. The first set of teeth 15 may be disengaged from the second set of teeth in order to rotate the table top.

The rotating mechanism provides an easy and safe pivoting movement from one extreme position to another. When the table top final positions are reached (e.g., fully vertical and fully horizontal) the free end portion of the limiting element 16 laterally slides into the wells 12.2 of the recess. Alternatively, the wells may laterally slide to around the limiting element 16 when the final positions of the table are reached. Regardless of the arrangement, the recess is laterally and rotationally fixed relative to one set of teeth while the limiting element is laterally and rotationally fixed relative to the other set of teeth. Rotationally fixed (or secured) is herein defined to mean that the objects rotationally fixed have constant angular and radial relationship about the axis of rotation, as viewed perpendicular to the axis of rotation, when the table top is rotated. Rotationally fixed objects may be translated relative to each parallel to the axis of rotation. The wells are of sufficient depth to facilitate the first set of teeth 15 interlocking and engaging with the second set of teeth 17 so that the pivot mechanism is stable and secure. The non-well portions of the recess may lack sufficient depth to allow the teeth to interconnect. By preventing the teeth from interconnecting at the non-well portions, the recess acts to ensure a smooth rotational movement of the table top between predetermined positions. The wells 12.2 may be wider than the limiting element 16 by a tooth width in order to ensure that the first and second sets of teeth can interlock with each other when the limiting element is located within the well. For example, the working position of the table top 2 can be varied to the horizontal position, but larger accidental pivoting is prevented. Additional wells 12.2 in the recess 12.1 may be provided to allow a user to adjust the table top to stable intermediate positions such as at a 45 degree angle. In the illustrated embodiment, the outer ring 12 is firmly secured to the cylindrical outer surface of the bearing piece 11, while the limiting element 16 is fixed on the longitudinal beam 4. A reverse arrangement is contemplated where the outer ring 12 is located on the longitudinal beam 4 while the limiting element 16 is located on the bearing piece 11.

Figure 5C:
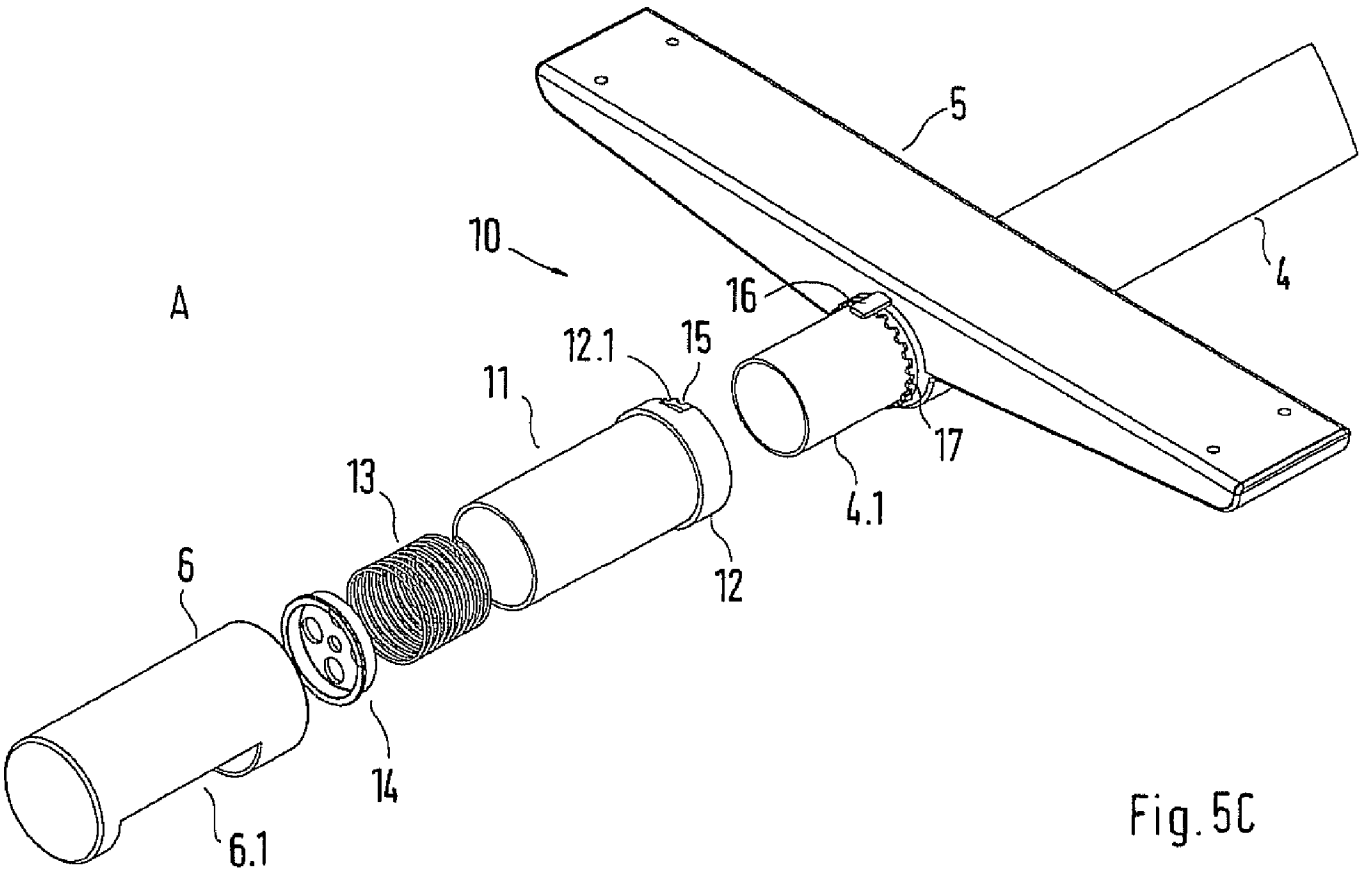
Figure 6A:
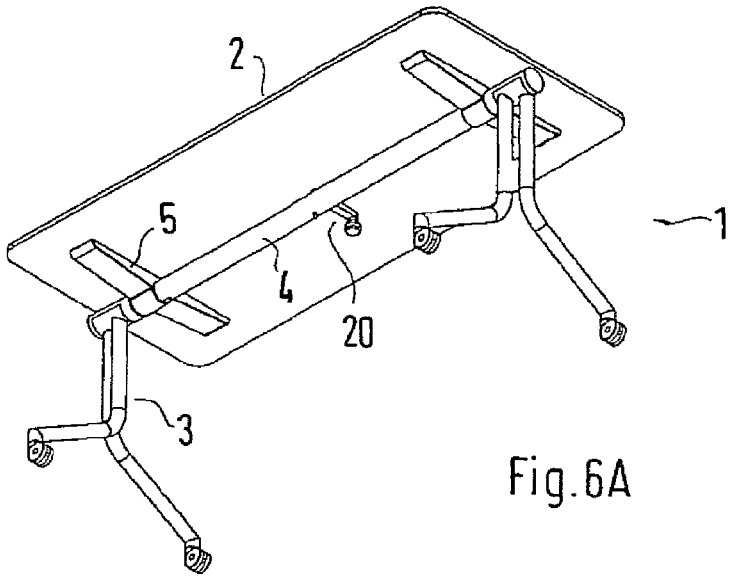
FIGS. 6A through 6E show the table of FIG. 1B in a perspective view from below, from a narrow side view of the back, on the underside with a boom traverse view, inverse view, and in a further perspective view from below marked with the line rods.
Figure 6B:
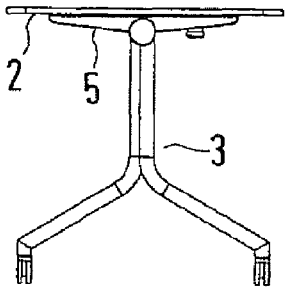
Figure 6C:
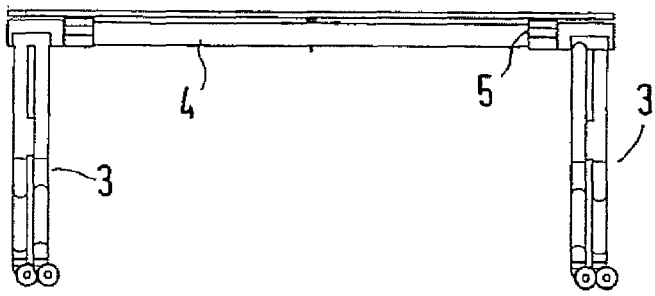
Figure 6D:
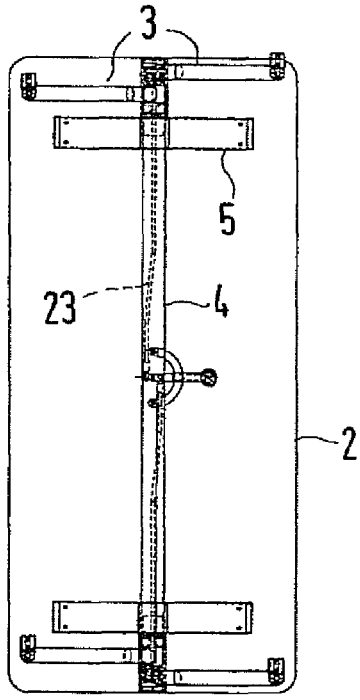
Figure 6E:
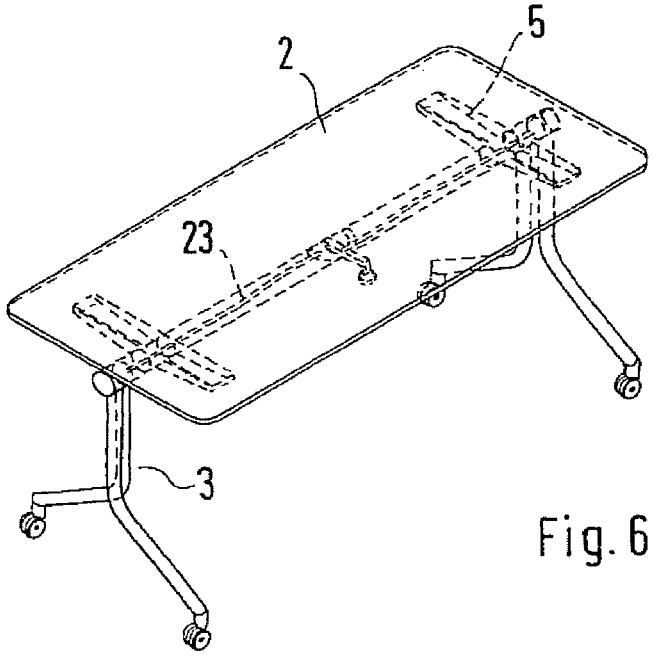
Figure 7A:
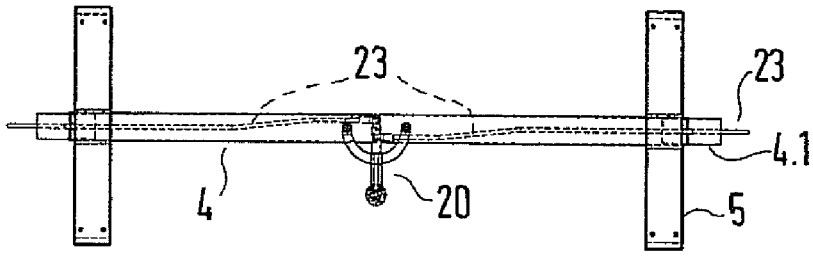
FIGS. 7A through 7D show plan, front, perspective, and narrow side views of the longitudinal beam and cross members attached to a draw-rod system.
Figure 7B:
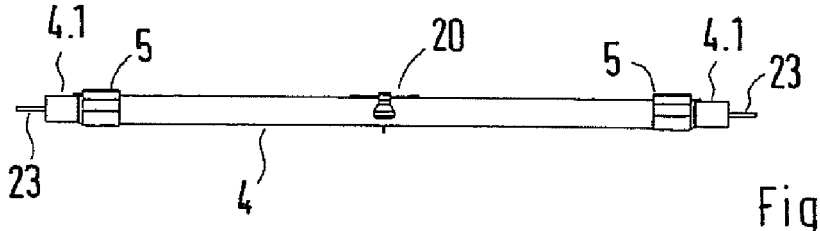
Figure 7C:
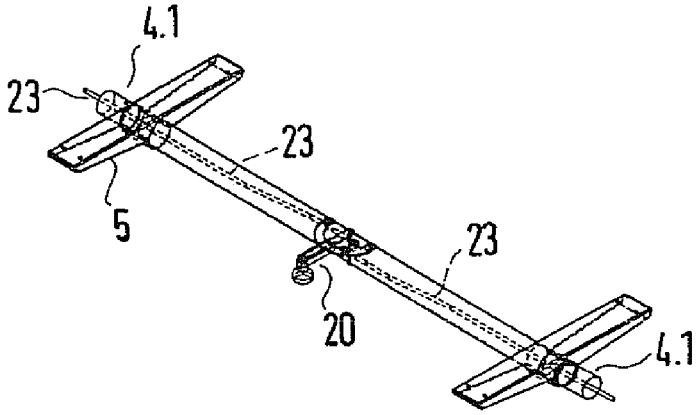
Figure 7D:
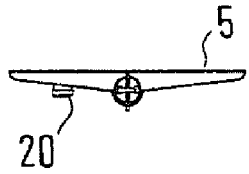

Exploded views of the bearing piece 11 are shown in FIGS. 5B and 5C. A helical compression spring 13 acts to axially hold the bearing piece 11 against the spigot 4.1. The compression spring 13 is supported by a supporting part 14 such as an annular flange or a cap. The compression spring 13 acts upon the bearing piece 11 which in turn pushes the first set of teeth 15 towards the second set of teeth 17. In order to disengage the teeth, a linkage 23 shown in FIGS. 5A and 7A through 7D engages the bearing piece 11 through the supporting part 14 and laterally pushes the bearing piece so that the first set of teeth 15 disengages from the second set of teeth 17. Alternatively, the spring may act to disengage the first set of teeth from the second set of teeth while the linkage acts to pull the two sets of teeth into engagement.

The linkage 23 extends through the interior of the bearing piece 11, the spigot 4.1 and the longitudinal beam 4 to an operating mechanism 20. As shown in FIG. 5A, the operating mechanism includes a hand operating portion 21 that pivots along an arc-shaped guide 22. The hand operating portion pivots around a point in the interior of the longitudinal beam 4 while coupled to a portion of the linkage 23. By rotating the hand operating portion 21, the linkage 23 is longitudinally moved through the longitudinal beam 4 to release the bearing section 11. The first set of teeth 15 may be released from the second set of teeth 17 so that the table top may be rotated. When the hand operating portion 21 returns to its original position, the linkage laterally travels through the longitudinal beam 4 and the compression spring retracts to engage the first set of teeth with the second set of teeth.

As shown in the drawings, the swivel mechanism includes a first set of teeth 15 interlocking with a second set of teeth 17 and a limiting element 16 on both sides of the table 1. The operating mechanism 20 has dual linkages 23 that include two individual rods coupled in the manner previously described. Thus both pivot mechanisms 10 are operated with only one operating mechanism 20 with the hand operating portion 21 so that only one hand is needed for operation. The operating mechanism 20 is designed so that it locks the engagement of the first tooth section 15 to the second tooth section 17, on either side of the table 1, against the force of the spring 13. When the operating mechanism releases the bearing piece 11, the first tooth section 15 is disengaged from the second tooth section 17.

The end cap 6, which is installed before attaching the table legs 3 to the pivot mechanism 10, is installed on an end portion of the longitudinal beam 4 so that the end portion of the longitudinal beam is completely covered. Around the table legs 3, the supporting shells 3.4 are secured to the bearing piece 11 by screws or welding. To facilitate installation of the end cap 6, it has a shape adapted to fit into the supporting shells 3.4. The front end of the end cap 6 is located below the table top 2 or may be flush with a narrow side of the table top.

I claim:

1. A table having a tilting table top rotatable about a rotational axis, the tilting table top secured to a table frame with a pivoting mechanism, the table frame secured to a table leg;

the pivoting mechanism lockable in both a horizontal use position and a folded storage position;

the pivoting mechanism includes a limiting element within a track having a first well and a second well, the limiting element located within the first well when the pivoting mechanism is locked in the horizontal use position, and the limiting element located within the second well when the pivoting mechanism is locked in the folded storage position;

the pivoting mechanism having a first set of teeth interlocking with a second set of teeth;

the first set of teeth circumscribing the rotational axis and having a first plurality of teeth extending, parallel to the rotational axis, towards the second set of teeth;

the second set of teeth circumscribing the rotational axis and having a second plurality of teeth extending, parallel to the rotational axis, towards the first set of teeth;

one of the first and second sets of teeth movable along the rotational axis relative to the other of the first and second sets of teeth;

the first set of teeth rotationally secured to the table leg; and the second set of teeth rotationally secured to the tilting table top.

2. The table of claim 1, wherein the table frame includes a circular hollow cylindrical section circumscribing the rotational axis, second set of teeth rigidly secured to the circular hollow cylindrical section.

3. The table of claim 2 wherein the table frame includes a cross member secured to the table top extending perpendicular to the circular hollow cylindrical section, a portion of the second set of teeth located adjacent to the cross member.

4. The table of claim 3 further comprising the limiting element located adjacent to the cross member.

5. The table of claim 2, wherein the pivoting mechanism includes a bearing piece slidable along the axis of rotation and rotationally secured to the table leg.

6. The table of claim 5, wherein the bearing piece surrounds a portion of the circular hollow cylindrical section of the frame.

7. The table of claim 6, wherein the limiting element is rigidly secured to circular hollow cylindrical section of the frame;

the track is cylindic and the bearing piece includes the track having the first well and the second well.

8. The table of claim 7, wherein the first set of teeth is interlocked with the second set of teeth when the limiting element is in the first well.

9. The table of claim 7, wherein a spring inside the bearing piece acts to push the first set of teeth away from the second set of teeth;

the first set of teeth are rigidly secured to the bearing piece;

a linkage extends from the bearing piece through the circular hollow cylindrical section to a hand operable mechanism; and operation of the hand operable mechanism actuates the linkage parallel to the axis of rotation and pushes the first set of teeth towards the second set of teeth.

10. The table of claim 7, wherein a spring inside the bearing piece acts to pull the first set of teeth towards from the second set of teeth.

11. The table of claim 10 further comprising an actuating mechanism located within the circular hollow cylindrical section of the frame, the actuating mechanism laterally translating the bearing piece along the axis of rotation to engage and disengage the first set of teeth from the second set of teeth.

12. The table of claim 11 wherein the table leg includes a double column.

13. The table of claim 1, wherein the track includes a cylindric surface curved about the axis of rotation;

the first well extending away from the cylindric surface parallel to the axis of rotation; and the second well extending away from the cylindric surface parallel to the axis of rotation.

14. The table of claim 1 wherein the one of the first and second sets of teeth is movable along the rotational axis relative to the other of the first and second sets of teeth by at least the depth of one tooth of the first and second plurality of teeth.

15. A table having a tilting table top rotatable about a rotational axis, the tilting table top secured to a table frame with a pivoting mechanism, the table frame secured to a table leg;

the pivoting mechanism lockable in both a horizontal use position and a folded storage position;

having a first circular set of teeth interlocking with a second circular set of teeth;

including a bearing piece slidable along the axis of rotation and rotationally secured to the table leg, rigidly secured to the first circular set of teeth, and having a cylindric track with a first well and a second well; and including a limiting element rigidly secured to the second circular set of teeth, moveable within the cylindric track, located within the first well when the pivoting mechanism is locked in the horizontal use position, and located within the second well when the pivoting mechanism is locked in the folded storage position.

16. The table of claim 15 further comprising a main beam circumscribing the rotational axis and secured to the table top;

a hand operable mechanism within the main beam;

a linkage within the main beam connecting the bearing piece to the hand operable mechanism; wherein operation of the hand operable mechanism actuates the linkage and bearing piece along the axis of rotation.

17. The table of claim 15 wherein a spring inside the bearing piece acts to push the first set of teeth away from the second set of teeth.

18. The table of claim 15 wherein the first set of teeth is interlocked with the second set of teeth when the limiting element is in the first well.

19. A table comprising a tilting table top rotatable about a rotational axis, the tilting table top secured to a table frame with a pivoting mechanism, the table frame secured to a table leg;

the pivoting mechanism lockable in both a horizontal use position and a folded storage position;

the pivoting mechanism having a first set of teeth interlocking with a second set of teeth;

the first set of teeth circumscribing the rotational axis and having a first plurality of teeth extending, parallel to the rotational axis, towards the second set of teeth;

the second set of teeth circumscribing the rotational axis and having a second plurality of teeth extending, parallel to the rotational axis, towards the first set of teeth;

one of the first and second sets of teeth movable along the rotational axis relative to the other of the first and second sets of teeth;

the first set of teeth rotationally secured to the table leg;

the second set of teeth rotationally secured to the tilting table top;

the table frame includes a circular hollow cylindrical section circumscribing the rotational axis, second set of teeth rigidly secured to the circular hollow cylindrical section;

the pivoting mechanism includes a bearing piece slidable along the axis of rotation and rotationally secured to the table leg;

the bearing piece surrounds a portion of the circular hollow cylindrical section of the frame;

the first set of teeth are rigidly secured to the bearing piece;

a linkage extends from the bearing piece through the circular hollow cylindrical section to a hand operable mechanism; and operation of the hand operable mechanism actuates the linkage parallel to the axis of rotation.

20. The table of claim 19 wherein a spring inside the bearing piece acts to push the first set of teeth away from the second set of teeth.

* * * * *